US006671921B1

(12) United States Patent
Hickman

(10) Patent No.: US 6,671,921 B1
(45) Date of Patent: Jan. 6, 2004

(54) MAGICARPET BROOM

(76) Inventor: Bradley L. Hickman, 2417 Sundance Dr., O'Fallon, MO (US) 63366

( * ) Notice: Subject to any disclaimer, the term of this patent is extended or adjusted under 35 U.S.C. 154(b) by 0 days.

(21) Appl. No.: 09/567,222

(22) Filed: May 9, 2000

(51) Int. Cl.[7] ..... A46B 9/02; A46B 15/00

(52) U.S. Cl. ..... 15/186; 15/159.1; 15/200; 15/142

(58) Field of Search ..... 15/186, 187, 197, 15/200, 142, 159.1, 402; 56/400.01, 400.17, 400.16, DIG. 12; 119/612, 615, 618, 621, 625, 664

(56) References Cited

U.S. PATENT DOCUMENTS

| | | | | | |
|---|---|---|---|---|---|
| 727,035 | A | * | 5/1903 | Van Loan | |
| 2,202,215 | A | * | 5/1940 | Lutz | 15/186 |
| 2,432,098 | A | * | 12/1947 | Horn | 306/3 |
| 3,421,171 | A | * | 1/1969 | Tsuruzawa | 15/173 |
| 3,538,533 | A | * | 11/1970 | Woods | 15/236 |
| 3,766,588 | A | * | 10/1973 | Kopecky | 15/186 |
| 3,766,590 | A | * | 10/1973 | Wachtel | 15/186 |
| 4,042,995 | A | * | 8/1977 | Varon | 15/142 |
| 4,044,724 | A | * | 8/1977 | Merchill | 119/83 |
| 4,244,168 | A | * | 1/1981 | Howard | 15/142 |
| 4,504,998 | A | * | 3/1985 | Price et al. | 132/313 |
| 4,635,658 | A | * | 1/1987 | Chang | 132/151 |
| 4,831,678 | A | * | 5/1989 | Dietsche | 15/106 |
| 5,267,528 | A | * | 12/1993 | Murieen | 119/88 |
| 5,379,723 | A | * | 1/1995 | Branley | 119/601 |
| 5,509,378 | A | * | 4/1996 | Kimura | 119/94 |
| 5,778,478 | A | * | 7/1998 | Coleman | 15/143.1 |
| 5,930,862 | A | * | 8/1999 | Garrett | 15/142 |
| 6,112,359 | A | * | 9/2000 | Kaleta | 15/142 |
| 6,367,422 | B1 | * | 4/2002 | Wilhelmi | 119/625 |

* cited by examiner

*Primary Examiner*—Robert J. Warden, Sr.
*Assistant Examiner*—Laura C Cole
(74) *Attorney, Agent, or Firm*—Henry W. Cummings

(57) ABSTRACT

A carpet is cleaned by drawing the broom over it, capturing animal hair and other objects from the carpet. The broom has a handle, preferably round of ½" to 2" diameter made of relatively rigid material such as wood, plastic, metal, or composite material. The handle is from about 4' to 5' long, providing comfort for the user while affording good control of the broom head. The handle is attached to the head by means of a threaded connection, adhesive, or other suitable means adequate to ensure the handle remains connected to the head, and preferably is removable for storage and/or travel. The head is 2" to 6" deep and comprises a base made of relatively rigid material such as wood, plastic, metal or other suitable material, having an arcuate long dimension of ½' to 1 & ½' at an angle of 5 to 25 degs., and a short dimension of 2" to 6". The base includes on its lower surface a frame of ⅛" to ½" surronding a rubber pad, having a a series of bristles extending through the pad.

7 Claims, 2 Drawing Sheets

MAGICARPET BROOM

I FIELD OF THE INVENTION

This invention relates to brooms, particularly for removing animal hair, and other debris.

II BACKGROUND OF THE INVENTION

U.S. Pat. No. 727,035 discloses a brush having a head whose angle can be adjusted relative to the handle to facilitate cleaning in corners or in odd angles.

U.S. Pat. No. 2,202,215 discloses a hand carding tool with a working surface that can be adjusted from flat to curved or arcuate. This adjustment is accomplished by means of a wing nut or similar device, maintaining proper tension throughout.

U.S. Pat. No. 2,432,098 discloses a handle operated broom, brush, or like article. The handle is adjustable relative to the head to allow the full face of the broom to contact the surface to be cleaned. The head is further movable in 90 degree increments to allow for cleaning in confined areas, and to prevent the bristles from being deformed due to prolonged use in one direction.

U.S. Pat. No. 3,421,171 discloses a hand held cleaning brush whose head may be rotated 180 degrees relative to the handle by various means. These means can include: the head pivots on the handle, the head can be removed from the handle and replaced 180 degrees opposite to its original position, or the handle can swing from one side of the head to another.

U.S. Pat. No. 3,538,533 discloses a handle operated nap raising device whose head and handle are not adjustable relative to one another, but the head is short enough to facilitate its being used under furniture. The nap of the carpet is raised by means of studs mounted on the working surface of the device's head. The studs employ grooves of various designs to capture the carpet filaments, pulling them up and raising the nap. No cleaning action occurs during this operation.

U.S. Pat. No. 3,766,588 discloses a handle operated nap raising device whereby the angle between the head and handle changes during use. Spiked wheels hold the head a certain height above the carpet while capturing the fibers of the carpet, raising the nap. No cleaning action occurs during this operation.

U.S. Pat. No. 3,766,590 discloses a hand held brush. Metal pins, horsehair bristles, or the like are imbedded in a bulging pad of some resiliently deformable material. The pad has a retaining ring surrounding and attached to its periphery. The ring fits in a slot in the handle, keeping it mechanically connected to the handle in a superior fashion to merely being glued together. No adjustment of the relative positions of head and handle is possible.

U.S. Pat. No. 4,042,995 discloses a handle operated tool for removing animal hair from carpeting. The relative angle of the handle to the head is not adjustable. The head contains a series of polyethylene bristles arranged in a number of longitudinal rows across the head. The arrangement of the bristles on the head is such that there are successively more of them toward the trailing edge to capture increasing amounts of hair. The bristles are also gradually shortened from back to front, causing the head to tilt downward facilitating ease of use. It appears this design is sold commercially under the tradename ONE SWEEP DELUXE.

U.S. Pat. No. 4,044,724 discloses a hand-held grooming and dispensing brush head. This device is used to apply a insecticidal or other treatment material while animal or human hair is being groomed. There is no provision for adjusting the relative angle of handle and head. A flexible-walled container is attached to the handle whereby the material from the container is conveyed through a passage in the handle to an opening in the head. The material is then applied to and distributed over the surface during grooming.

U.S. Pat No. 5,267,528 discloses a hand-held animal grooming brush. There is no provision for adjusting the relative angle of handle and head. The head contains a plurality of bristles to capture loose hair from the animal being groomed. A perforated plate is oriented next to the head at the base of the bristles with the bristles protruding through the perforations. The plate can be moved away from the head toward the ends of the bristles, stripping the loose animal hair from the bristles. This plate is actuated by means of a spring-loaded device mounted in the handle, providing an easy means of removing the hair from the brush.

U.S. Pat. No. 5,509,378 discloses a hand held brush and method of grooming a pet which allows vigorous brushing of all areas of a pet's body while maintaining the brushing action in a line with the brush's handle. The brush uses a rectangluar shaped head containing a plurality of bristles. The brush head can be rotated 360 degrees in 45 degree increments about the handle, but the angle of the handle relative to the head is fixed. Rotating the brush head effectively changes the width of the bristle area presented to the pet's body, allowing smaller areas to be groomed while still maintaining efficient pulling action on the brush.

The foregoing references are hereby incorporated into the present application by this reference as if fully set forth herein.

IV SUMMARY OF THE INVENTION

The object of the present invention is to efficiently remove animal hair and other debris from carpeting.

In accordance with the present invention, the broom 10 includes handle 20 and head 40. Head 40 is made of wood, plastic, or other suitable material, and comprises receiver 48 and broom base 41. Receiver 48 and broom base 41 can either be one molded or formed part, or two separate, permanently attached parts. Receiver 48 provides a means of attaching handle 20 to head 40. Handle 20 can be attached inside receiver 48 with internal female threads 46, a commercially available adhesive, or other means. Handle 20 is round in cross section, and can be made of wood, plastic, metal, or other suitable material. Handle 20 can attach to receiver 48 with male threads 25, commercially arcuate long dimension 43 of ½' to 1 &½' at an angle of 5 to 25 degs., and a short dimension of 2" to 6". The base 41 includes on its lower surface a frame 50 of ⅛" to ½" surronding a rubber pad 55. having a series of bristles, preferably metal, extending through the rubber pad. The rubber pad is surrounded by the frame, and both are attached to the head with an adhesive. The 0.01" to 0.075" thick bristles protrude 0.5 to 1.5" through the rubber mat, then assume a tip angle of between 45 and 75 degrees. The tip length is ⅛" to ½". The bristles are laid in rows 1/16" 5/16" apart across the base at a 45 to 75 degree angle to facilitate efficient removal of foreign material.

IV. THE DRAWINGS

V DESCRIPTION OF PREFERRED EMBODIMENTS

Figure 1:
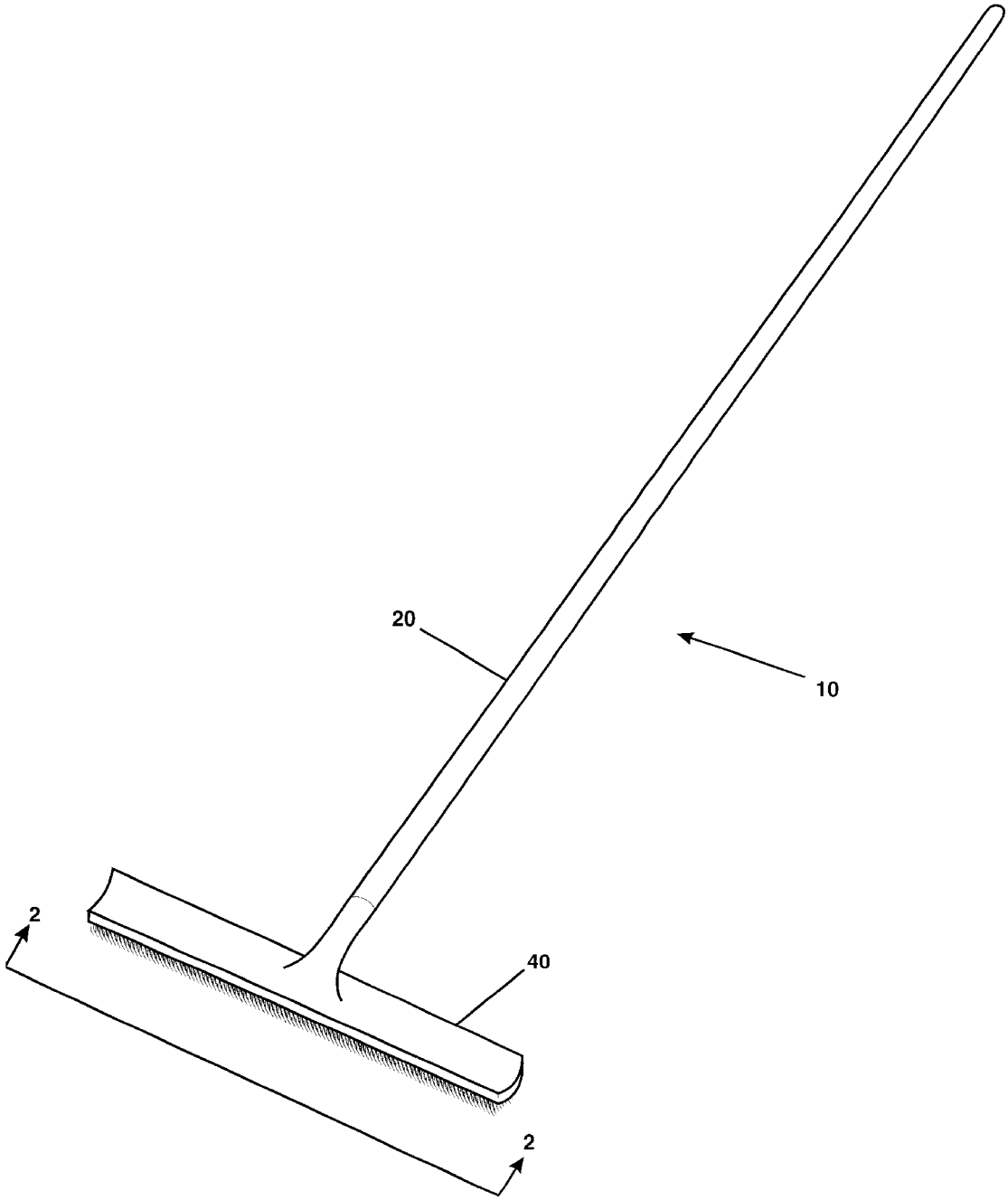
FIG. 1 is a perspective view of the present invention.
Figure 2:
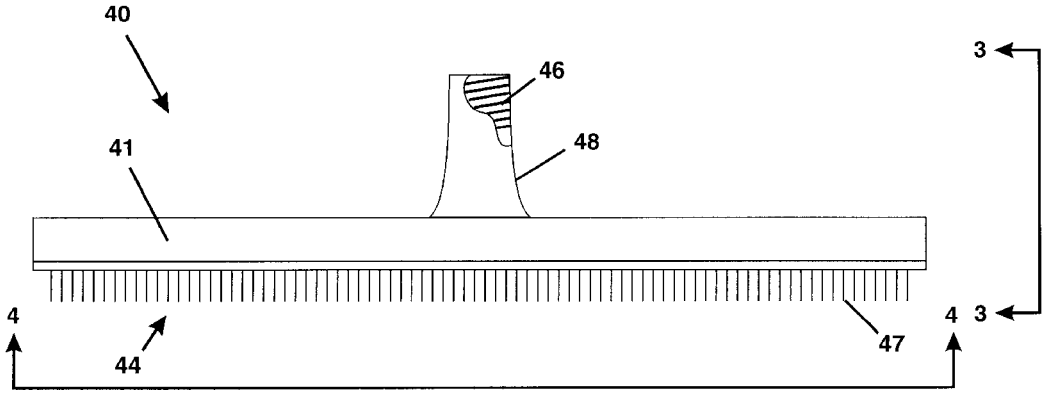
FIG. 2 is a view looking in the direction of the arrows along the line 2—2 in FIG. 1.
Figure 4:
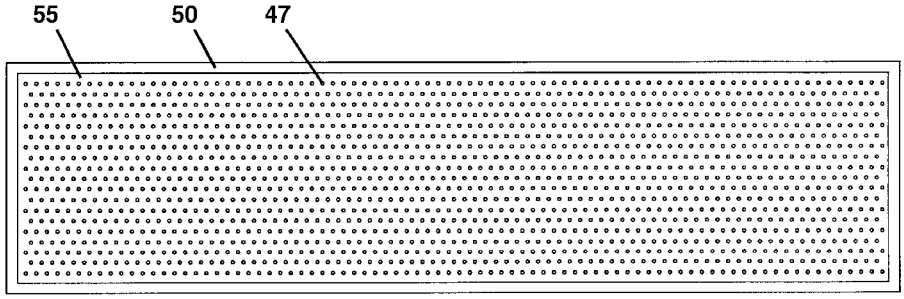
FIG. 4 is a. view looking in the direction of the arrows along the line 4—4 in FIG. 2
Figure 3:
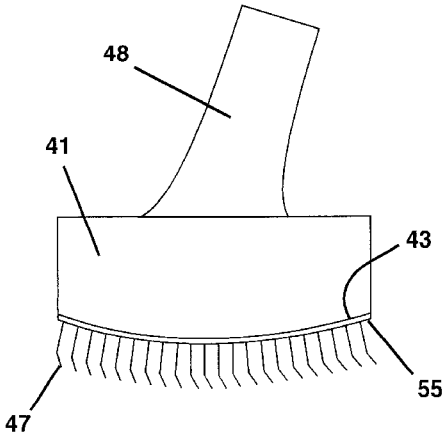
FIG. 3 is a view looking in the direction of the arrows along the line 3—3 in FIG. 2.
Figure 6:
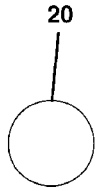
FIG. 6 is a view looking in the direction of the arrows along the line 6—6 in FIG. 5.
Figure 5:
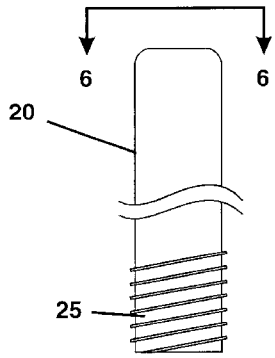
FIG. 5 is a detail front view of the handle.

In accordance with the present invention, the broom 10 includes handle 20 and head 40.

Head 40 is made of wood, plastic, or other suitable material, and comprises receiver 48 and broom base 41. Receiver 48 and broom base 41 can either be one molded or formed part, or two separate, permanently attached parts. Receiver 48 provides a means of attaching handle 20 to head 40. Handle 20 can be attached inside receiver 48 with internal female threads 46, a commercially available adhesive, or other means.

Handle 20 is round in cross section, and can be made of wood, plastic, metal, or other suitable material. Handle 20 can attach to receiver 48 with male threads 25, commercially available adhesive, or other means.

Broom base 41 has an arcuate bottom surface 43. A rubber mat 55 is surrounded by a plastic frame 50 corners, both are bonded to broom base 41 with a commercially available adhesive. Bristles 44 protrude through the rubber mat 55, and are angled to facilitate efficient cleaning.

The broom handle 20 is preferably round of ½" to 2"diameter made of relatively rigid material such as wood, plastic, metal, or composite material. The handle 20 is from about 4' to 5' long, providing comfort for the user while affording good control of the broom head.

The handle 20 is attached to the head 40 by means of a threaded connection 46, adhesive, or other suitable means (not shown) adequate to ensure the handle remains connected to the head, and preferably is removable for storage and/or travel.

The head 40 is 2" to 6" deep and comprises a base 41 made of relatively rigid material such as wood, plastic, metal or other suitable material, having an arcuate long dimension 43 of ½' to 1&½' at an angle of 5 to 25 degs., and a short dimension of 2" to 6". The bottom of the base 43 is curved or arcuate at an angle of between 5 to 25 degree on a 3–5" radius. This makes the broom act more effeciently than prior art brooms as the operator pulls the handle inward. The base 41 includes on its lower surface a frame 50 of ⅛" to ½" surronding a rubber pad 55, having a a series of bristles 44 extending through the rubber pad. The rubber pad 55 is surrounded by the frame 50, and both are attached to the head 41 with an adhesive.

The 0.01"to 0.075" thick bristles 44 preferably made of metal such as steel, aluminum or aluminum alloy protrude 0.5 to 1.5" through the rubber mat, and include a tip 47 formed at an angle of between 45 and 75 degrees. The tip length is ⅛" to ½". The bristles are laid in rows ⅙" 5⁄16" apart across the base at a 45 to 75 degree angle to facilitate efficient removal of foreign material. This close knit pattern of metal bristles with 45 to 75 degree angle bend, and the ⅙" to 5⁄16" tip provides effective animal; hair and debris removal. This design also provides strength and durability.

A carpet is cleaned by drawing the broom over it, capturing animal hair and other objects from the carpet. The bottom of the base 43 is curved or arcuate at an angle of between 5 to 25 degree radius, which allows the rows of bristles to sequentially contact the surface to be cleaned when the handle is raised, lowered, and pulled toward the user. This makes the broom act more effeciently than prior art brooms as the operator pulls the handle inward. The weight of the broom is generally a sufficient downward force to remove animal hair, and avoid the need to bare down. The light weight design also gives the operator a comfortable feel as animal hair and other debris is picked up.

VII What is claimed is:

1. An improved broom comprising:

a broom handle hat, a broom bead attached thereto;

said broom handle having a length of from about 4' to 5' long;

said broom head being made of relatively rigid material and comprising means for receiving said handle and a broom base;

said broom base comprising an arcuate bottom surface;

said base having an arcuate long dimension of ½' to 1 & ½' a resilient mat integrally connected to said broom base;

said base having an arcuate long dimension at an angle of 5 to 25 degs, broom bristles protruding through said mat;

said bristles being 0.01" to 0.075" thick;

said bristles protrude 0.5 to 1.5" through said resilient mat;

said bristles have a tip length from ⅛" to ½";

said bristles comprising an angle bend and a generally vertically extending tip, and wherein said bristles assume a tip angle of between 45 and 75 degree, and wherein said bristles are laid in rows 1⁄16" to 5⁄16" apart across the base.

2. An improved broom according to claim 1 wherein said broom bristles are made of metallic material.

3. An improved broom according to claim 1 wherein said base is made of relatively rigid material selected from wood, plastic, metal, and composite material.

4. An improved broom according to claim 1 wherein said head is 2" to 6" deep.

5. an improved broom according to claim 1 wherein a frame surronds said resilient pad.

6. An improved broom according to claim 1 wherein said frame is from ⅛" to ½" surronding said resilient pad.

7. An improved broom according to claim 1 wherein said bristles are laid at a 45 to 75 degree angle to facilitate removal of foreign material including animal hair.

* * * * *